US005909715A

United States Patent [19]

Menon

[11] Patent Number: 5,909,715

[45] Date of Patent: Jun. 8, 1999

[54] METHOD OF CONVERSION OF A VESSEL FROM SINGLE TO DOUBLE HULL

[76] Inventor: Prabhakaran Alek Menon, No. 23, Jalan Pucung 7, Taman Perling, 81200 Johor Bahru, Malaysia

[21] Appl. No.: 08/739,896

[22] Filed: Oct. 30, 1996

[30] Foreign Application Priority Data

Oct. 30, 1995 [MY] Malaysia ..... PI 950 3264

[51] Int. Cl.[6] ..... B63B 25/08

[52] U.S. Cl. ..... 114/65 R; 114/74 R

[58] Field of Search ..... 114/65 R, 79 R, 114/79 W, 74 A, 74 R

[56] References Cited

U.S. PATENT DOCUMENTS

| | | | |
|---|---|---|---|
| 3,943,873 | 3/1976 | Hering et al. | 114/74 R |
| 4,087,979 | 5/1978 | Pearlson . | |
| 5,218,919 | 6/1993 | Krulikowski, III et al. . | |
| 5,379,711 | 1/1995 | Fischer et al. . | |

FOREIGN PATENT DOCUMENTS

| | | | |
|---|---|---|---|
| 54-38099 | 3/1979 | Japan | 114/74 A |
| 55-63983 | 5/1980 | Japan | 114/74 R |
| 57-15091 | 1/1982 | Japan | 114/74 A |
| 58-47696 | 3/1983 | Japan | 114/74 R |
| 864581 | 4/1961 | United Kingdom . | |
| 1349093 | 3/1974 | United Kingdom . | |
| 1402468 | 8/1975 | United Kingdom . | |
| 1586788 | 3/1981 | United Kingdom . | |
| 92/10396 | 6/1992 | WIPO . | |
| 92/22457 | 12/1992 | WIPO . | |

*Primary Examiner*—Ed L. Swinehart
*Attorney, Agent, or Firm*—Knobbe, Martens, Olson & Bear

[57] ABSTRACT

A method of conversion of a single hull vessel to a double hull vessel is provided and has at least the steps of:

(a) positioning a section of a second hull shell beneath a first hull of a vessel;

(b) raising the section of second hull shell to locate it adjacent the first hull; and (c) attaching the section of second hull shell to the first hull.

In a preferred method, the second hull shell is positioned in relation to the first hull by male and female locating members disposed on adjacent portions of the first and second hulls. The method is carried out in a dry dock or, alternatively, using a ship-lifting system. The second hull has side and end sections formed of substantially hollow steel blocks, and the bottom section has transverse ribs for additional strength. Thus, a double hull vessel of the present invention has substantially the same interior capacity as the single hull vessel before the conversion.

2 Claims, 3 Drawing Sheets

METHOD OF CONVERSION OF A VESSEL FROM SINGLE TO DOUBLE HULL

BACKGROUND OF THE INVENTION

This invention relates to a method of conversion of a single hull vessel to a double hull vessel.

Owing to international concern over oil spillage from tankers, the International Maritime Organization is putting in place regulations which mandate double hull tankers. Existing single hull tankers will need to be converted to double hulls within a specified period. (See Marpol Regulations effective from Jul. 6, 1995 for crude oil tankers over 20,000 tons DWT and product tankers over 30,000 tons DWT). In addition, the U.S. Oil Pollution Act of 1990 requires all existing tankers to have double bottoms by 1997.

It is therefore recognized that a method of converting vessels from a single hull to a double hull is required. Existing methods of conversion require the vessel to be docked in a dry dock, during which time the ship owners lose business. Known conversion techniques are carried out inside the vessel by adding a second hull within the existing hull. This has the disadvantage of reducing the available storage capability of the vessel.

SUMMARY OF THE INVENTION

Thus, one aspect of the present invention provides a time-efficient method of conversion of a single hull vessel to a double hull vessel without sacrificing the internal capacity of the original single hull vessel. According to the present invention, there is provided a method of conversion of a vessel comprising the steps of:

(a) positioning a section of a second hull shell beneath a first hull of a vessel;

(b) raising the section of second hull shell to locate it adjacent the first hull; and (c) attaching the section of second hull shell to the first hull to form a double hull arrangement.

The method of conversion of a vessel may use a ship-lift system; alternatively, the method may be carried out in a dry dock. The present invention does not diminish the available cargo storage capacity of the converted vessel.

Versatile ship lifting equipment is available with precise setting for accurate loading of vessels, and this invention utilizes such equipment. One example is disclosed in U.S. Pat. No. 4,087,979.

Preferably, the section of a second hull shell is lowered on a lifting means, and the vessel is positioned above the lifting means. The lifting means may thereafter be raised to bring the section of second hull shell into a position adjacent the first hull of the vessel. The locating of the section of second hull shell in relation to the first hull may be by means of a locating means such as male and female locating members disposed on adjacent portions of the first and second hulls.

Preferably, the lifting means lifts the combined vessel and section of second hull to a site for addition of remaining sections of the second hull and treatment. Also, preferably, the second hull shell has transverse ribs for providing strength to the double hull. The first hull may be an existing outer hull of a vessel, the vessel being converted to a double hull vessel. Preferably, ballast tanks can be placed within the second hull. Existing ballast tanks within the first hull may be converted to cargo tanks. Thus, in one embodiment, a multiple hull sea vessel of the present invention comprises an original hull to which has been added an additional exterior hull.

In an additional aspect of the present invention, a sea vessel converted from a single hull construction to a double hull construction comprises a first hull fabricated at a first time period and a second hull attached to the exterior of the first hull at a second time period, wherein after the first time period and before the second time period the vessel was sailed having only the first hull.

In another aspect of the present invention, a method of assembly or repair of a vessel using a ship-lift system, where the vessel has an existing first hull, comprises the steps of:

(a) lowering a section of a second hull shell on a lifting device and positioning the vessel above the lifting device;

(b) raising the lifting device to bring the section of second hull shell into a position adjacent the first hull of the vessel;

(c) attaching the section of second hull shell to the first hull; and (d) lifting the combined vessel and section of second hull to a site for attachment of remaining sections of the second hull to the vessel.

BRIEF DESCRIPTION OF THE DRAWINGS

Embodiments of the present invention will now be described with reference to the accompanying drawings, in which.

DETAILED DESCRIPTION OF THE PREFERRED EMBODIMENT

Figure 3:
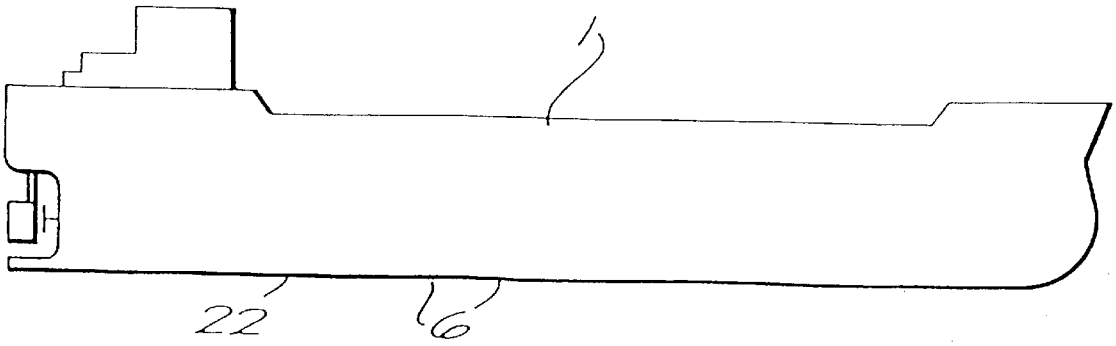
FIG. 3 is a side elevational view of a single hull vessel in accordance with the preferred method of the present invention.
Figure 9A:
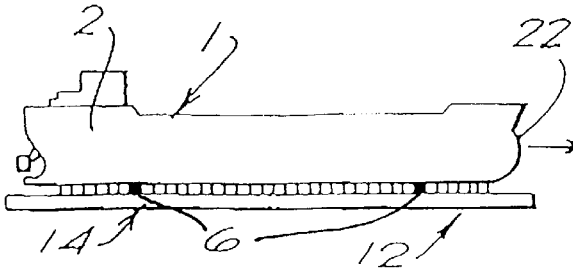
FIGS. 9*a* and 9*b* are side elevational views of a vessel with a first hull showing male locating members in accordance with the preferred method of the present invention.
Figure 9B:
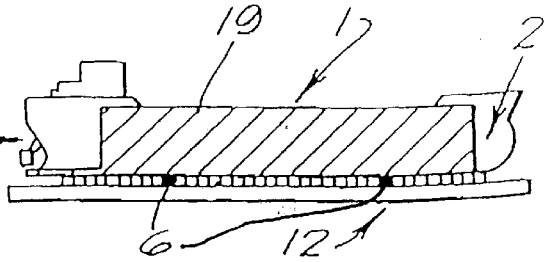

Referring to the drawings, a method of conversion of a vessel is described, in particular, for adding a second hull 4 to a vessel 1 with an existing single hull 2 (see FIG. 3 and FIGS. 9*a* and 9*b*). The method can be used in a dry dock or by using a ship-lifting system. The ship-lifting system has the advantage of a quicker assembly time, thereby being advantageous to shipowners who have their ships out of service for a shorter period, and such systems are known to those skilled in the art.

The preferred method involves the following steps. The vessel 1 is identified for conversion to a double hull vessel, and all the key drawings for the vessel 1 are obtained from the shipowner or drawn up to provide details of the general arrangement and construction profile, the shell expansion, capacity plan, lines and offset, and the piping arrangement. The vessel 1 may need to be brought to the shipyard for detailed checking of the vessel profile and to verify all critical dimensions.

Figure 1:
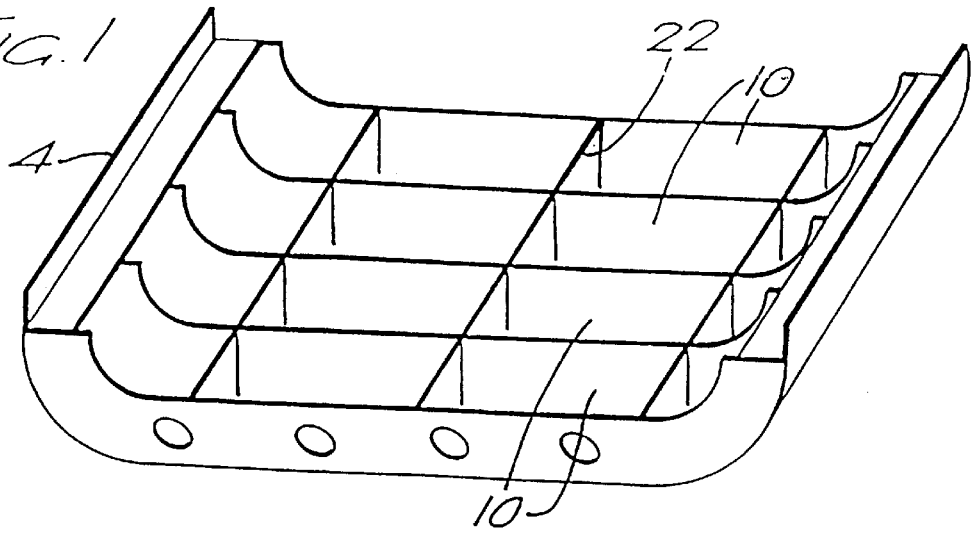
FIG. 1 is a perspective view of a section of the second hull used in accordance with a preferred method of the present invention.
Figure 2:
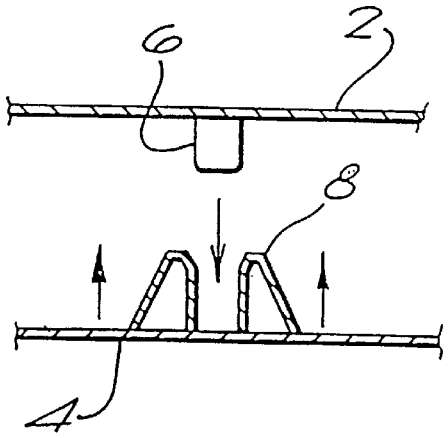
FIG. 2 is a cross-sectional view of the locating means between the first and second hulls in accordance with the preferred method of the present invention.
Figure 4A:
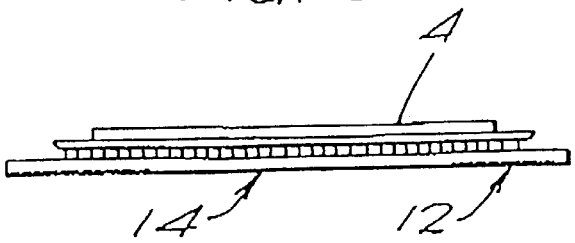
FIGS. 4*a* and 4*b* are a side elevational and a cross-sectional view, respectively, of the section of the second hull of FIG. 1.
Figure 8A:
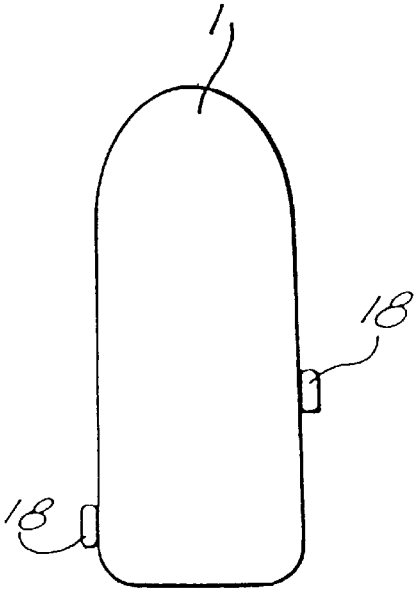
FIGS. 8*a* and 8*b* are diagrammatic plan views of a vessel with a section of second hull attached and with additional sections attached, respectively, in accordance with the preferred method of the present invention.
Figure 8B:
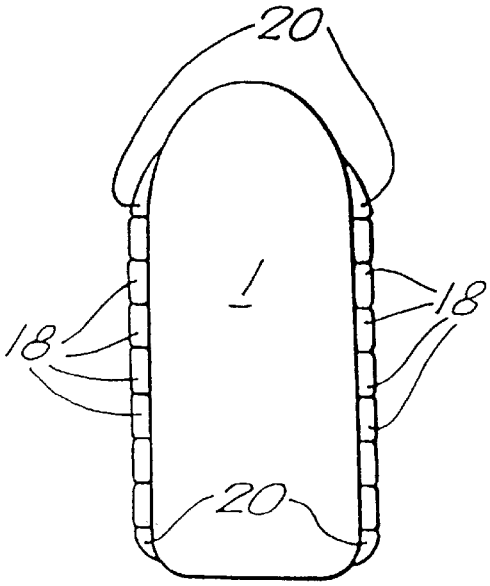

The main bottom section of second hull 4, side sections 18, and end sections 20 are fabricated as steel structures based on the ship's specification drawings (see FIGS. 4*a,* 4*b,* 8*a* and 8*b*). The bottom section of second hull 4 has sets of female locating members 8 attached to correspond with male locating members 6 on the vessel 1. Corresponding male locating members 6 (see FIG. 2) are added to the exterior of the existing first hull 2 of the vessel 1. The male and female locating members 6, 8 facilitate precise positioning of the bottom section of second hull 4 in relation to the first hull 2 of the vessel 1. The bottom section of second hull 4 has parallel transverse ribs 10 normal to the direction of the keel 22 of the vessel 1. The ribs 10 strengthen the section of the second hull 4 and provide rigidity (see FIG. 1). Preferably, the side sections 18 of second hull 4 are hollow blocks, and the end sections 20 of second hull 4 are tapered hollow blocks (see FIG. 8*b*).

Figure 6A:
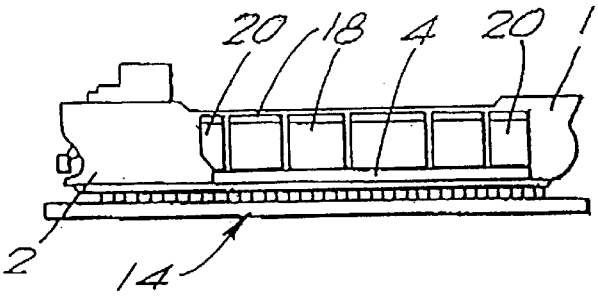
FIGS. 6*a* and 6*b* are a side elevational and an end elevational view, respectively, of a vessel having remaining sections of a second hull attached in accordance with the preferred method of the present invention.

New pipes and other fittings are prefabricated for fitting in new double-bottom tanks which will be ballast tanks between the first and second hulls 2, 4. Any original ballast tanks within the first hull 2 of the vessel 1 may be converted to cargo tanks. The sections 18, 20 of the second hull are sandblasted and painted. This completes the preparation that can be carried out without having the vessel 1 out of commission (see FIGS. 4*a,* 4*b,* and 8*b*). At this time the vessel 1 is docked and lifted by a ship lift 12 and transferred to a land berth. Alternatively, the vessel 1 could be docked in a dry dock (see FIG. 6*a*).

Figure 4B:
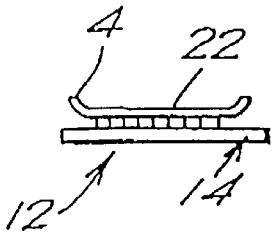

The existing external shell 19 of the first hull 2 of the vessel 1 is completely sandblasted and repainted with a primer followed by a suitable paint scheme (see FIGS. 9*a* and 9*b*). The male locating members 6 are fitted onto the bottom plate of the first hull 2 of the vessel 1. The vessel 1 is transferred from the land berth to the ship lift platform, lowered, and floated. Alternatively, if the dry dock system is being used, the vessel 1 is floated and removed from the dry dock. The main bottom section of second hull 4, which has been prefabricated as described above, is assembled on the land berth over suitable cradles and bogies (not shown). The section of second hull 4 is transferred to the platform 14 of the ship lift 12, and the platform 14 is lowered into the sea (see FIGS. 4*a* and 4*b*).

Figure 5A:
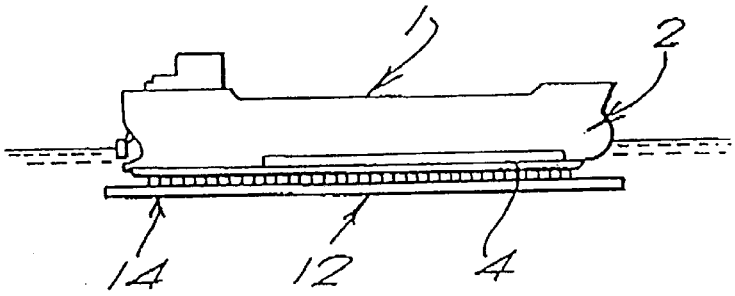
FIGS. 5*a* and 5*b* are a side elevational and an end elevational view, respectively, of a vessel having a section of second hull located and being lifted in accordance with the preferred method of the present invention.
Figure 5B:
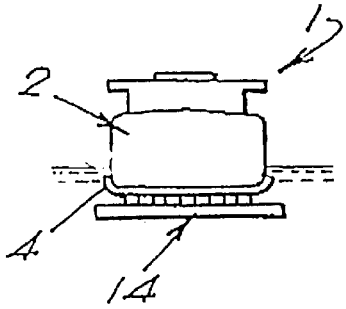
Figure 7A:
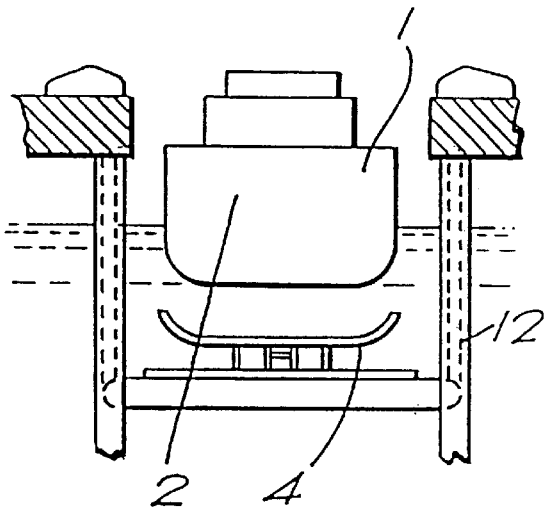
FIGS. 7*a* and 7*b* are partial cross-sectional views of a section of second hull on a lift platform before and after attachment to a first hull in accordance with the preferred method of the present invention.
Figure 7B:
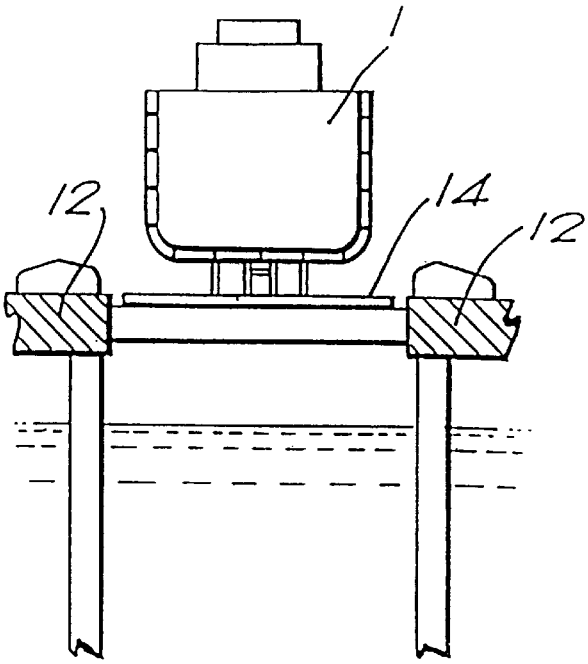

Referring to FIGS. 5*a,* 5*b* and 7*a,* the vessel 1 is docked over the platform 14 of the ship lift 12, ensuring sufficient clearance between the vessel's first hull 2 and the section of second hull 4 on the platform 14. The platform 14 is then raised by the ship lift 12 so that the male locating members 6 on the first hull 2 fit accurately into the female locating members 8 (see FIG. 7*b*). The vessel 1, now with a double hull on the bottom portion, formed of the first hull 2 and the section of second hull 4, is transferred to the land berth. If the dry dock arrangement is being used, the section of second hull 4 is supported on blocks. The dry dock can be flooded in order to allow the vessel 1 to be positioned over the second hull 4. The dry dock can be drained for further work on the vessel 1, as described below.

Figure 6B:
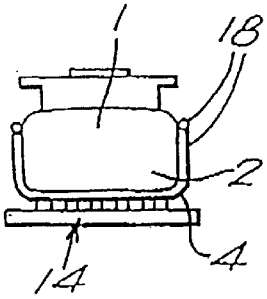

The exterior of the first hull 2 and the interior of the bottom section of second hull 4 are thoroughly washed with fresh water, and the first and second hulls 2, 4 are welded together. A number, in this example four (see FIGS. 6*a* and 6*b*), of side sections of second hull 18 in the form of hollow blocks having a double-skin shell structure are positioned on each side of the vessel 1 adjacent the first hull 2 and above the bottom section of the second hull 4 by yard cranes (not shown). End sections 20 of the second hull 4 are also positioned on the vessel 1, and these have a tapered profile at the forward and aft ends of the vessel 1 in order to ensure that the first hull 2, bottom section of second hull 4, and side sections 18 of second hull 4 are jointed smoothly. The remaining modification works such as installing new ballast pipes, bottom plugs, sea chests, and relocating or modifying underwater fittings are carried out.

Upon completion of the modification works, the vessel 1 with its double hull is transferred to the platform 14 of the ship lift 12 and lowered into the sea. If the dry dock system is being used, the dry dock is flooded and the vessel 1 floated (see FIG. 7*b*). The entire vessel systems are tested and a sea trial conducted.

The resulting double hull vessel constructed in accordance with the present invention has a first hull 2 which is the original hull of the vessel 1, with a bottom section of second hull 4 located to the first hull 2 by male and female locating members 6, 8 between the two. The second hull is then attached by welding. A number of double-skinned side sections 18 of second hull 4 are disposed along the sides of the vessel 1, with tapered end sections 20 of second hull 4 at each forward and aft position. The method of the present invention may alternatively be used to assemble a multiple hull vessel, or advantageously be used in the repair of a single hull vessel.

The embodiments described above are provided to merely illustrate the method of conversion of a vessel from a single to double hull of the present invention. Changes and modifications may be made from the embodiments presented herein by those skilled in the art without departure from the spirit and scope of the invention, as defined by the appended claims.

What is claimed is:

1. A method of assembly or repair of a vessel using a ship-lift system, the vessel having an existing first hull, the method comprising the steps of:

(a) lowering a section of a second hull shell on a lifting device and positioning the vessel above the lifting device;

(b) raising the lifting device to bring the section of second hull shell into a position adjacent the first hull of the vessel;

(c) attaching the section of second hull shell to the first hull; and (d) lifting the combined vessel and section of second hull to a site for attachment of remaining sections of the second hull to the vessel.

2. A method as claimed in claim 1, wherein the section of second hull shell is located in relation to the first hull by locating members comprising male and female locating members, either of the male or female locating members disposed on the first hull and the other of the male or female locating members disposed on the second hull.

* * * * *